US006289979B1

(12) United States Patent
Kato

(10) Patent No.: US 6,289,979 B1
(45) Date of Patent: Sep. 18, 2001

(54) HEAT EXCHANGER

(75) Inventor: Souichi Kato, Konan (JP)

(73) Assignee: Zexel Corporation, Tokyo (JP)

( * ) Notice: Subject to any disclaimer, the term of this patent is extended or adjusted under 35 U.S.C. 154(b) by 0 days.

(21) Appl. No.: 09/555,483

(22) PCT Filed: Dec. 2, 1998

(86) PCT No.: PCT/JP98/05419

§ 371 Date: Jun. 1, 2000

§ 102(e) Date: Jun. 1, 2000

(87) PCT Pub. No.: WO99/30100

PCT Pub. Date: Jun. 17, 1999

(30) Foreign Application Priority Data

Dec. 8, 1997 (JP) ..... 9-354154

(51) Int. Cl.[7] ..... F28F 9/02
(52) U.S. Cl. ..... 165/173; 138/89
(58) Field of Search ..... 165/173; 138/89

(56) References Cited

U.S. PATENT DOCUMENTS 1,301,010 * 4/1919 Schrade ..... 138/89
1,569,875 * 1/1926 Nixon ..... 138/89
4,046,168 * 9/1977 Milne ..... 138/89
5,546,761 * 8/1996 Matsuo et al. ..... 62/509
5,649,588 * 7/1997 Lee ..... 165/67
5,836,384 * 11/1998 Wijkstrom et al. ..... 165/173
5,934,366 * 8/1999 Gowan ..... 165/174
6,035,931 * 3/2000 Kado et al. ..... 165/174

FOREIGN PATENT DOCUMENTS 4-57080 5/1992 (JP) .
6-24700 6/1994 (JP) .
6-74878 10/1994 (JP) .
7-29419 7/1995 (JP) .

* cited by examiner

*Primary Examiner*—Allen Flanigan
(74) *Attorney, Agent, or Firm*—Wenderoth, Lind & Ponack L.L.P.

(57) ABSTRACT

A heat exchanger that achieves a reduction in the dimensions of the header pipes, a sufficient level of strength against pressure and a structure that allows the caps to be washed thoroughly during the washing process is provided At each of the caps closing off the two ends of the cylindrical portion constituting a header pipe, a circular groove at which the circumferential edge at an end of the cylindrical portion is fitted over the entire circumference is formed to completely fit the cylindrical portion inside the cap so that the dimensions of the header pipe along the axial direction are reduced. In addition, by forming a thick portion at a closing portion, the pressure withstanding capability of the cap is improved. The cap also has a projected portion at its outer flat surface.

6 Claims, 5 Drawing Sheets

(a)

(b)

HEAT EXCHANGER

TECHNICAL FIELD

The present invention relates to a heat exchanger provided with a header pipe, the two ends of which are closed off with caps.

BACKGROUND ART

In a heat exchanger disclosed in Japanese Examined Utility Model Publication No. H7-3173, one end of the header, and more specifically, the lower lid closing off the lower end of the header, is provided with a collar, a fitting portion projecting out at the upper surface of the collar and a retaining projection projecting out at the lower surface of the collar, and the heat exchanger is mounted at a vehicle body by fitting the retaining projection at a retaining hole constituted of a vibration-damping rubber provided at the lower mounting plate secured to the vehicle body.

In addition, Japanese Unexamined Utility Model publication No. H5-45482 discloses a structure achieved by forming a side projection as an integrated part of a lid closing off the opening at the lower end of the header pipe and providing an insertion pin at the lower surface of this side projection so that the insertion pin is offset from the center of the axis of the header pipe along a specific direction. By adopting this structure, the position of the insertion pin can be selected freely over a wide range.

The invention disclosed in Japanese Unexamined Patent publication No. H5-332693 achieves simplification in bracket mounting by providing a male screw that is set erect at the outer end surface of a header cap closing off the lower end of the header pipe.

The invention disclosed in Japanese Unexamined Patent Publication No. H 9-26282 is provided with a lid assuming a structure different from that of the lid having the side projection disclosed in Japanese Unexamined Utility Model Publication No. H6-45482 mentioned above. The lid disclosed in this publication has an inward projection and a side projection provided as an integrated part of the inward projection and projecting out along the direction of the width of the tubes and is formed as a block body achieving a roughly L-shape in the plan view.

As an examination of the examples quoted above reveals, since the lower end of a heat exchanger mounted at a vehicle body is set near the vehicle body side panel, a means for retention to retain the heat exchanger at the vehicle body panel is provided at the lid that closes off the lower end of the tubes of the heat exchanger. However, it is not desirable to provide a means for retention such as a pin as an integrated part of the lid, since the pin tends to become skewed during the brazing process to such an extent that, in extreme cases, it can no longer be fitted at the mounting hole at the vehicle.

In addition, reflecting the increasing need for a reduction in the engine room space in recent years, the space available for mounting the heat exchanger has become smaller, thereby necessitating reduced dimensions in the heat exchanger.

Thus, the heat exchanger itself must become more compact. The lid (cap), which is normally manufactured through cold forging or the like, must be washed after it is formed since impurities such as the mold releasing agent and the press oil adhere to the manufactured cap. If the end of the cap is formed in a flat shape in this situation, a problem arises while washing the cap in that it may not be washed thoroughly. In addition, if the lid is formed in a flat shape, it is necessary to assure a specific thickness for the lid so that it can withstand pressure applied to the lid.

Accordingly, an object of the present invention is to provide a heat exchanger achieving a reduction in the header pipe dimensions and having a cap with a sufficient degree of strength against pressure, which can be washed thoroughly when washing the lid.

SUMMARY OF THE INVENTION

In order to achieve the object described above, in the heat exchanger according to the present invention comprising, at least, a pair of header pipes having inflow/outflow pipes through which a heat exchanging fluid flows in and out, a plurality of tubes communicating between the pair of header pipes and fins provided between the individual tubes, the header pipes are each provided with a cylindrical portion having insertion holes, into which the tubes are inserted and a pair of caps that close off the openings at the two ends of the cylindrical portion. The caps are each provided with a closing portion that closes off the open ends, a circumferential wall portion formed at the circumferential edge of the closing portion to be externally fitted at the circumferential edge at the end of the cylindrical portion and a circular groove formed between the closing portion and the base end at the inner circumferential surface of the circumferential wall portion at which the end of the cylindrical portion is fitted over the entire circumference, and the closing portion has a thick portion located inside the circular groove.

Thus, by adopting the present invention having the circular groove, in which the circumferential edge at the end of the cylindrical portion is fitted over the entire circumference, formed at each cap closing off one of the two ends of the cylindrical portion constituting each of the header pipes, the cylindrical portion is fitted inside the cap to reduce the dimensions of the header pipe along the axial direction. In addition, since the thick portion is formed at the closing portion, the thickness of the closing portion can be maintained at a specific value to achieve the object described above.

Furthermore, the side surface of the thick portion located toward the cylindrical portion is formed in an indented shape. This makes it possible to form the inner side surface of the thick portion in an arch to improve the strength against internal pressure.

The cap is provided with a projected portion projecting out along the direction of the length of the cylindrical portion at the outer end surface located on the opposite side from the cylindrical portion. One such projected portion may be formed at an approximate center of the outer end surface or a plurality of such projected portions may be formed over consistent intervals near the circumferential edge of the outer end surface.

Since the presence of the projected portions at the flat outer end surface of the cap prevents the cap from becoming placed in surface contact during the washing process, the washing solution is allowed to reach the end surface of the cap with a high degree of reliability to assure thorough washing.

DETAILED DESCRIPTION OF THE INVENTION

The present invention is now explained in further detail in reference to the attached drawings.

Figure 1:
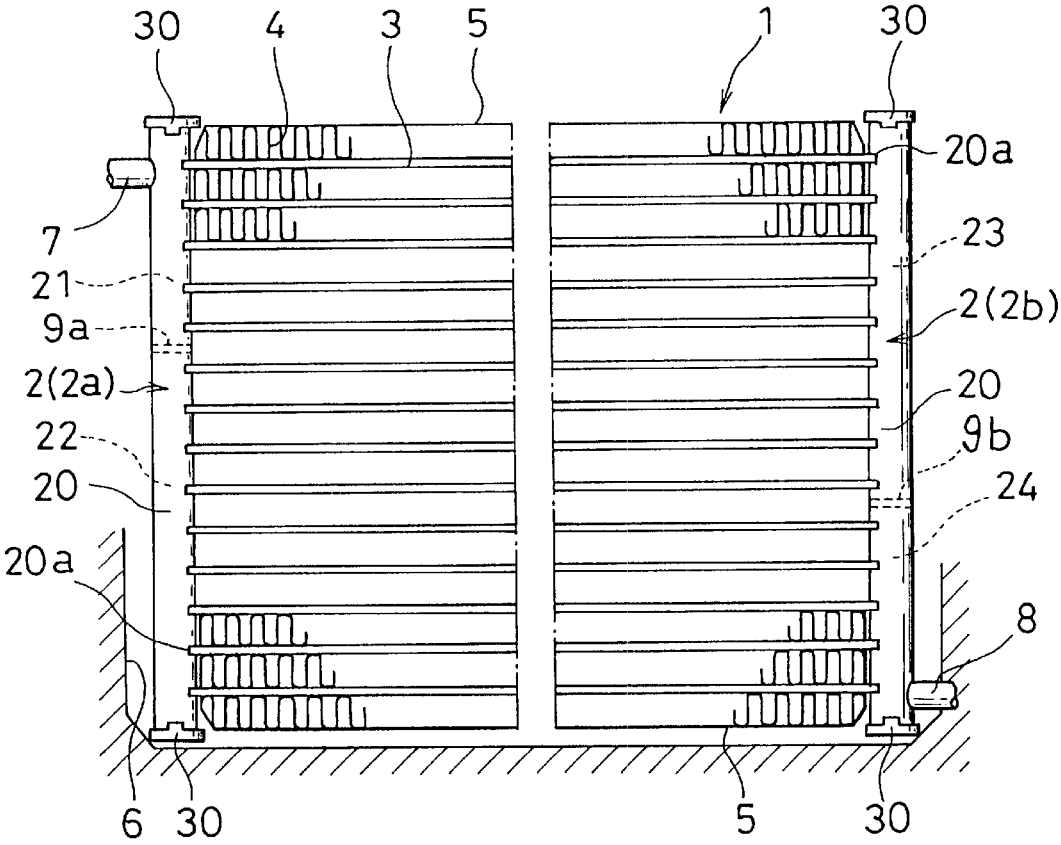
FIG. 1 is a partial frontal view illustrating the structure of a heat exchanger in an embodiment of the present invention.

A heat exchanger 1 shown in FIG. 1 may be, for instance, a condenser constituting a portion of a freezing cycle in an air-conditioning system for vehicles mounted in a vehicle. The condenser 1 comprises a pair of header pipes 2, a plurality of tubes 3 communicating between the pair of header pipes 2, fins 4 alternately laminated with the plurality of tubes 3 and a pair of side plates 5 holding the tubes 3 and the fins 4 at the two ends along the laminating direction, and is installed within a vehicle panel 6 provided in the engine room together with the radiator (not shown).

In this embodiment, the header pipes 2 include an intake-side header pipe 2*a* located on one side and provided with a coolant intake pipe 7 and an outlet side header pipe 2*b* located on the other side and provided with a coolant outlet pipe 8. In addition, the intake-side header pipe 2*a* is divided into two internal spaces 21 and 22 by a partitioning plate 9*a*, whereas the outlet-side header pipe 2*b* is divided into two internal spaces 23 and 24 by a partitioning plate 9*b*. It is to be noted that the header pipes 2 are each constituted of a cylindrical portion 20 having formed therein a plurality of tube insertion holes 20*a* at which the tubes 3 are inserted and caps 30 each closing off an opening at one of the two ends of the cylindrical portion 20.

In this structure, a coolant flowing into the internal space 21 through the coolant intake pipe 7 travels through the tubes 3 communicating with the internal space 21 to flow into the internal space 23. The coolant, having flowed into the internal space 23 travels through the tubes 3 communicating between the internal space 23 and the internal space 22 to reach the internal space 22, further travels through the tubes 3 communicating with the internal space 22 to flow into the internal space 24, and is finally discharged through the coolant outlet pipe 8 via the internal space 24. Thus, the coolant becomes condensed by discharging heat to the air passing through the fins 4 via the fins 4 while it travels through the three passes. As a result, a high-pressure gas coolant and a high-pressure liquid coolant condensed from the high-pressure gas coolant are both present in the condenser 1.

Figure 3:
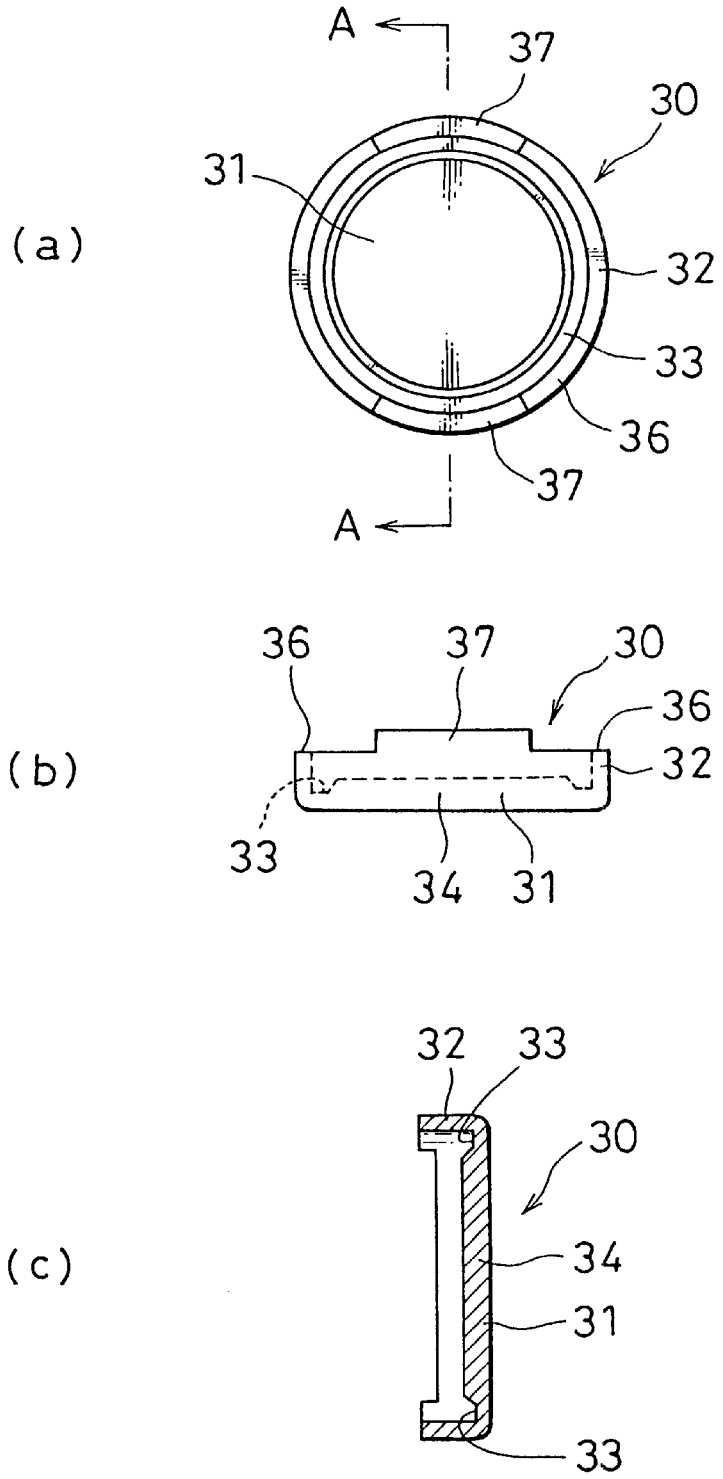
FIG. 3 illustrates a cap employed in a first embodiment of the present invention, with FIG. 3(*a*) presenting a plan view of the cap, FIG. 3(*b*) presenting its side elevation and FIG. 3(*c*) presenting a sectional view along line of FIG. 3(*a*)

As illustrated in FIGS. 3(*a*), 3(*b*) and 3(*c*), the caps 30 at the header pipes 2 are each constituted of a closing portion 31 that closes off an open end 25 of the cylindrical portion 20, a circumferential wall portion 32 formed at the circumferential edge of the closing portion 31 to be externally fitted at the circumferential edge of the end 25 of the cylindrical portion 20 and a circular groove 33 formed between the closing portion 31 and the base end of the inner circumferential surface of the circumferential wall portion 32 at which the end 25 of the cylindrical portion 20 is inserted over the entire circumference. In addition, a thick portion 34 is formed at the closing portion 31 in an area located within the circular groove 33. At a front end edge 36 of the circumferential wall portion 32, pipe insertion guide pieces 37 project out at specific positions.

Figure 2:
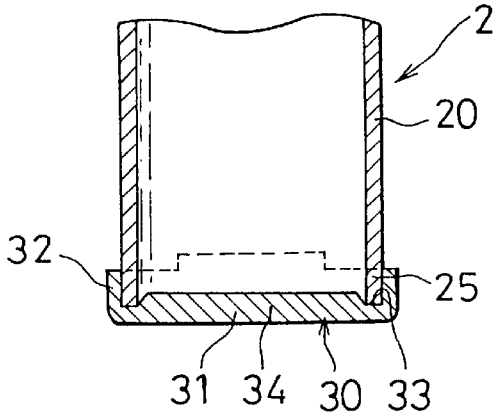
FIG. 2 is a sectional view in an enlargement of a header tank end in an embodiment of the present invention.

Thus, as shown in FIG. 2, the end 25 of the cylindrical portion 20 is inserted and secured at the circular groove 33 formed at the cap 30 to allow the dimensions of the header pipe 2 along the longitudinal direction to be set smaller by a specific degree. In addition, since the brazing material clad at the cylindrical portion 20 and/or the inner circumferential surface of the circumferential wall portion 32 of the cap 30 flows into, and is collected at the circular groove 33 to fix the cylindrical portion 20 and the cap 30 together during the furnace brazing process, the cylindrical portion 20 and the cap 30 can be brazed with reliability.

Furthermore, while the cylindrical portion 20, whose circumferential edge is round, withstands the internal pressure within the header pipe 2 with a high degree of reliability, the internal pressure is directly applied to the flat cap 30. Accordingly, the thick portion 34 is formed at the closing portion 31 of the cap 30 in the area located inside the circular groove 33 to achieve a specific level of pressure withstanding capability against the internal pressure within the header pipe 2.

Figure 4:
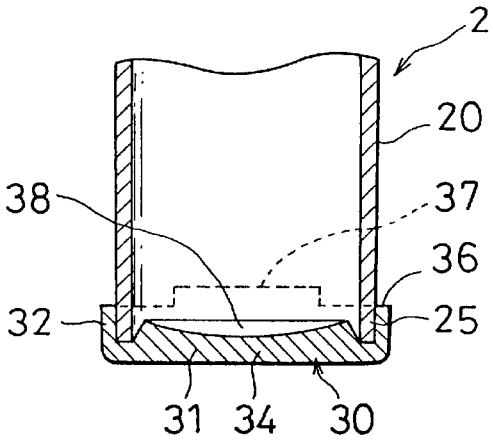
FIG. 4 is a sectional view in an enlargement of a header tank end, illustrating a cap adopted in a second embodiment.

The second embodiment illustrated in FIG. 4 adopts a structure having an indented portion 38 formed in an arch at the thick portion 34 in the area constituting the inner surface of the header pipe 2 to further improve the pressure withstanding capability of the thick portion 34. It is to be noted that in the second embodiment and the subsequent embodiments described below, the same reference numbers are assigned to identical components or components achieving similar functions to those in the first embodiment to preclude the necessity for repeated explanation thereof.

Figure 5:
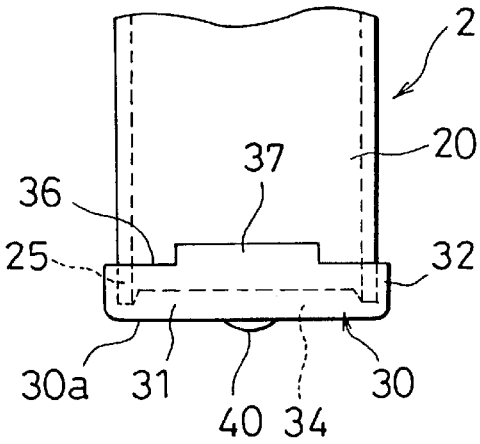
FIG. 5 illustrates a cap adopted in a third embodiment of the present invention, with FIG. 5(*a*) presenting an enlarged frontal view of the cap around a header tank end and FIG. 5(*b*) presenting its plan view.
Figure 5:
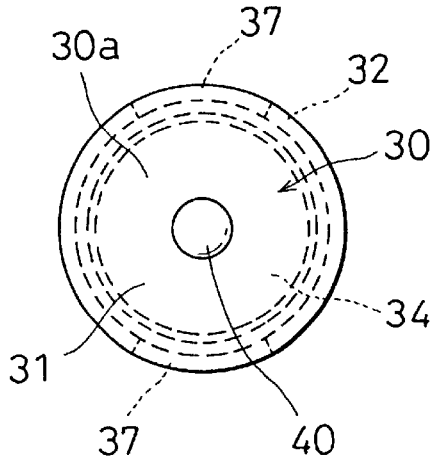

In addition, since the mold releasing agent, the press oil and the like adhere to the cap 30 manufactured through cold forging or the like, it is necessary to wash off these substances. Washing the caps is a crucial process that must be implemented without fail when manufacturing the caps 30. In order to ensure that the cleaning solution comes into contact with the flat surface of each cap reliably, a projected portion 40 projecting out at an approximate center of the outer flat surface 30*a* of the cap 30 is provided in the third embodiment shown in FIGS. 5(*a*) and 5(*b*). Since the projected portions 40 prevent the outer flat surfaces 30*a* from becoming stuck together during the washing process, thorough washing can be achieved with a high degree of reliability.

Figure 6:
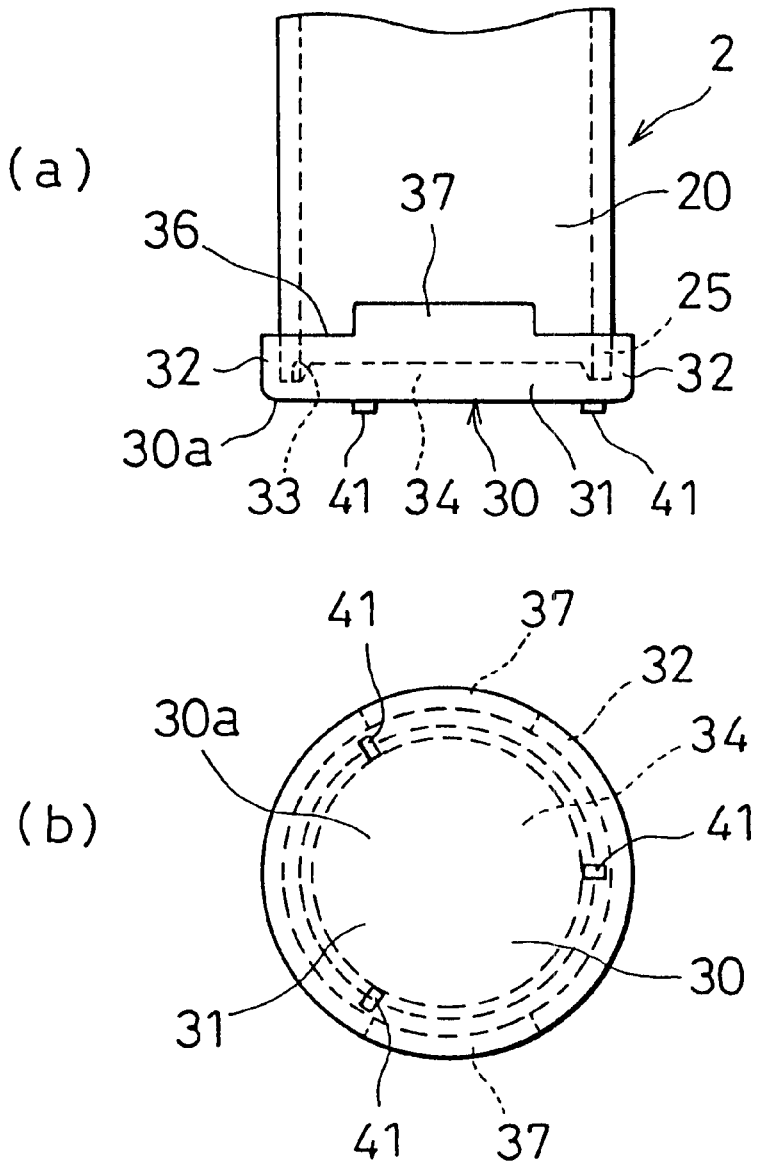
FIG. 6 illustrates a cap adopted a fourth embodiment of the present invention, with FIG. 6(*a*) presenting an enlarged frontal view of the cap around a header tank end and FIG. 6(*b*) presenting its plan view.

In the fourth embodiment illustrated in FIGS. 6(*a*) and 6(*b*), a plurality of projected portions 41 are provided over specific intervals near the external circumferential edge of the outer flat surface 30*a* of each cap 30. Thus, since the outer flat surfaces 30*a* can be effectively prevented from becoming stuck together, thorough washing is achieved with a high degree of reliability. It is to be noted that while three projected portions 41 are provided in this embodiment, no specific restrictions are imposed with regard to the number of projected portions as long as three or more projected portions are provided.

Figure 7:
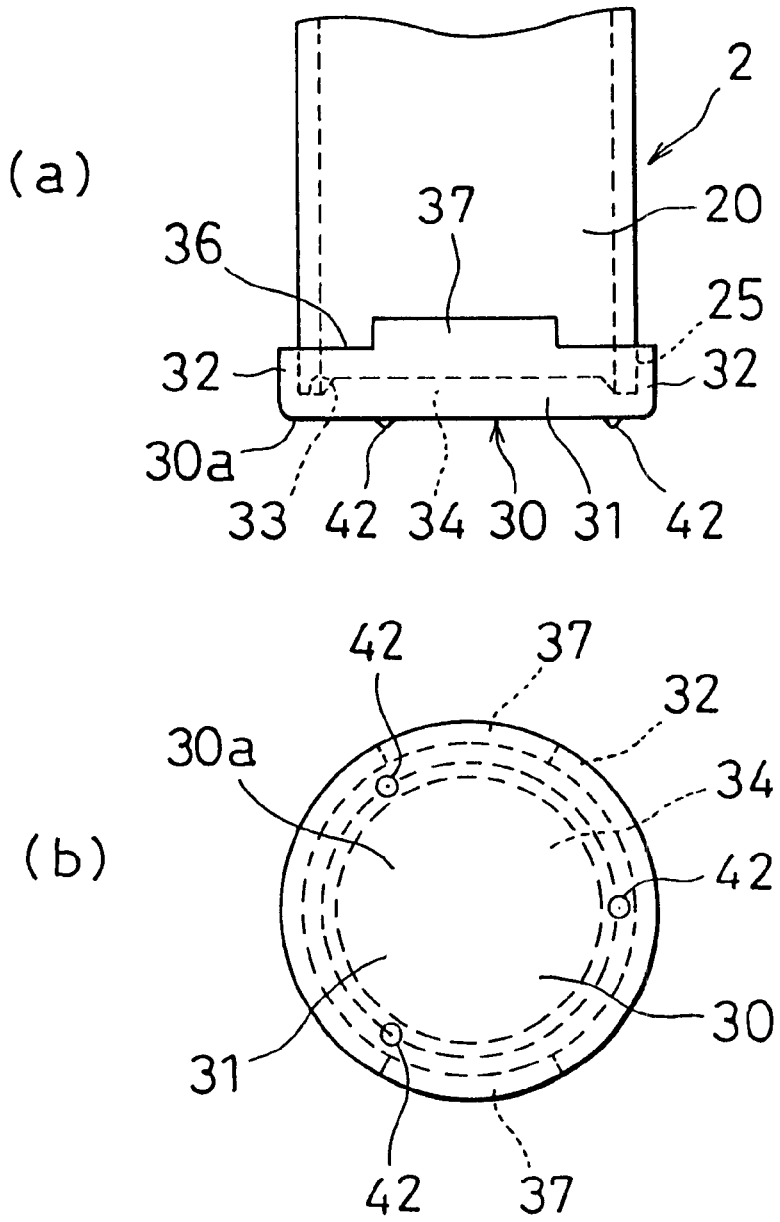
FIG. 7 illustrates a cap adopted in a fifth embodiment of the present invention, with FIG. 7(*a*) presenting an enlarged frontal view of the cap around a header tank end and FIG. 7(*b*) presenting its plan view.

Furthermore, in the fifth embodiment illustrated in FIGS. 7(*a*) and 7(*b*), a plurality of projections 42 are provided over specific intervals near the external circumferential edge of the outer flat surface 30*a* of each cap 30. Thus, since the outer flat surfaces 30*a* can be effectively prevented from becoming stuck together, thorough washing is performed in a reliable manner. In this case, three or more projections 42 may be provided without any particular restrictions, as in the case of the projected portions 41 described above.

Industrial Applicability

As explained above, according to the present invention in which each cap closing off one of the two ends of the cylindrical portion constituting each header pipe of the heat exchanger is provided with a circular groove at which the front end of the cylindrical portion is fitted, the dimensions of the header pipe can be reduced to a degree corresponding to the length of the front end of the cylindrical portion that is placed within the circular groove to achieve a reduction in the amount of space required within the engine room. In addition, with the thick portion formed at the closing portion that closes off each of the two ends of the cylindrical portion, the pressure withstanding capability against the internal pressure at the header pipe is improved, and at the same time, with the brazing material flowing into the groove, the cylindrical portion and the cap can be brazed together more reliably to improve the durability of the heat exchanger.

Furthermore, by forming at least one projected portion or projection at the outer flat surface of the cap, the manufactured cap is always thoroughly washed during the washing process to make it possible to dispense with a screening process or an inspection process that would otherwise have to be implemented after the washing process. As a result, a reduction in the cap manufacturing cost is achieved.

What is claimed is:

1. A heat exchanger comprising at least a pair of header pipes each having an inflow pipe or an outflow pipe through which a heat exchanging fluid flows in or out, a plurality of tubes communicating between said pair of header pipes and fins provided between said tubes, characterized in that:

said header pipes are each provided with a cylindrical portion having insertion holes through which said tubes are inserted and a pair of caps each blocking off one of the openings at the two ends of said cylindrical portion, said caps are each constituted of a closing portion that closes off said open end, a circumferential wall portion formed at the circumferential edge of said closing portion to be externally fitted with the circumferential edge at an end of said cylindrical portion and a circular groove formed between said closing portion and the base end of the inner circumferential surface of said circumferential wall portion at which said end of said cylindrical portion is inserted over the entire circumference, and said closing portion has a thick portion within said circular groove.

2. A heat exchanger according to claim 1, characterized in that:

a side surface of said thick portion located toward said cylindrical portion is formed in an indented shape.

3. A heat exchanger according to claim 1, characterized in that:

said caps are each provided with at least one projected portion projecting out along the direction of the length of said cylindrical portion at an outer end surface on the side opposite from said cylindrical portion.

4. A heat exchanger according to claim 3, characterized in that:

said at least one projected portion comprises a projected portion formed at an approximate center at said outer end surface.

5. A heat exchanger according to claim 3, characterized in that:

said at least one projected portion comprises a plurality of projected portions formed over consistent intervals near the circumferential edge of said outer end surface.

6. A heat exchanger according to claim 2, characterized in that:

said caps are each provided with a projected portion projecting out along the direction of the length of said cylindrical portion at an outer end surface on the side opposite from said cylindrical portion.

* * * * *